US006736472B2

(12) United States Patent
Banicevic

(10) Patent No.: US 6,736,472 B2
(45) Date of Patent: May 18, 2004

(54) REFRIGERATOR CABINET REFRIGERANT TUBE ASSEMBLY

(75) Inventor: Nedo Banicevic, Hamilton (CA)

(73) Assignee: Camco Inc., Mississauga (CA)

( * ) Notice: Subject to any disclaimer, the term of this patent is extended or adjusted under 35 U.S.C. 154(b) by 48 days.

(21) Appl. No.: 10/175,274

(22) Filed: Jun. 20, 2002

(65) Prior Publication Data

US 2003/0201701 A1 Oct. 30, 2003

(51) Int. Cl.[7] ..... A47B 96/04
(52) U.S. Cl. ..... 312/406; 312/401
(58) Field of Search ..... 312/400, 401, 312/404, 406, 406.1, 407, 296; 62/440, 451

(56) References Cited

U.S. PATENT DOCUMENTS

| | | | | |
|---|---|---|---|---|
| 3,599,442 A | | 8/1971 | Hanson | 62/419 |
| 4,165,105 A | | 8/1979 | Hahn | |
| 4,186,945 A | | 2/1980 | Hahn | |
| 5,248,196 A | | 9/1993 | Lynn et al. | 312/406 |
| 5,335,988 A | | 8/1994 | Lynn et al. | 312/406 |
| 5,784,896 A | * | 7/1998 | Tronnes et al. | 62/407 |
| 5,985,189 A | | 11/1999 | Lynn et al. | |

FOREIGN PATENT DOCUMENTS

| | | | |
|---|---|---|---|
| GB | 837384 | * 6/1960 | 312/406 |
| JP | 279975 | * 11/1990 | 312/406 |

* cited by examiner

*Primary Examiner*—James O Hansen

(57) ABSTRACT

There is disclosed a support tube for use in supporting a refrigerant tube within the insulation of a refrigerator cabinet. The support tube is mounted at it's lower end by a shoulder to extend through an exit opening in the bottom wall of the shell from the compressor motor housing up through a cavity space between the rear walls of the inner liner and the outer cabinet shell and into an insulation block. The insulation block has a passageway that faces downwardly, vertically into the cavity and curves gently to a refrigerant suction tube access opening in the inner liner. This opening and a corresponding opening in the tube have an elliptical shape which together with the gentle curvature of the tube permits for the easy insertion of the refrigerant tube in through the liner access opening, through the tube, and into the compressor motor. The use of the tube permits for field servicing of the refrigerant tube, positively locates the refrigerant tube in the rear cavity thereby reducing the risk of sweating associated with the refrigerant tube being shifted close to the rear walls during foaming and eliminates an unsightly and spatial encumbering refrigerant tube protruding beyond the rear wall of the outer shell of the refrigerator cabinet.

19 Claims, 4 Drawing Sheets

REFRIGERATOR CABINET REFRIGERANT TUBE ASSEMBLY

TECHNICAL FIELD OF THE INVENTION

The present invention relates to the refrigeration system utilized in a refrigerator and in particular relates to a support tube for supporting a refrigerant suction tube within a refrigerator cabinet.

BACKGROUND OF THE INVENTION

In the construction of a domestic refrigerator, it is common practice to locate the evaporator coil of the refrigerator system in close proximity to the freezer compartment of the refrigerator. In some instances, the evaporator coil is mounted adjacent the rear wall of the inner liner of the refrigerator cabinet and is covered by a cover plate. Alternatively, the mullion divider between the fresh food compartment and the freezer compartment of the refrigerator is adapted to house the evaporator coil. Circulation of air by a fan located in the evaporator housing forces air over the evaporator coil to cool the fresh food and freezer compartments.

In this type of refrigerant system, a compressor motor is mounted at the bottom at the refrigerator cabinet below the outer shell. The compressor motor receives refrigerant from the evaporator coils through a suction refrigerant tube. The suction refrigerant tube is either mounted on the exterior of the back wall of the outer shell of the cabinet or is positioned within the outer wall of the cabinet, behind the rear wall of the inner liner and within the foam in place insulation. Both of these placements of the suction tube have associated disadvantages. When the suction refrigerant tube passes from the evaporator coil through the rear walls of the inner liner and the outer shell, the suction tube extends down along the outer rear wall of the refrigerator cabinet spaced therefrom. The protrusion of the suction tube is both unpleasantly visible and limits the distance that the refrigerator cabinet can be pushed back towards a kitchen wall. When the refrigerant suction tube passes from the evaporator coil through the inner liner of the refrigerator and down a foam filled cavity located between the inner liner and the rear wall of the outer shell to the compressor motor, the suction tube cannot be readily replaced and is not accessible for field servicing. Further, this arrangement has the disadvantage that the suction tube typically is located spaced from the rear wall of the refrigerator liner and may be shifted closer to the rear wall during the foaming operation resulting in sweating along the rear wall.

Clearly, a refrigerant suction tube having the advantages of serviceability at a later date, non-sweating, and not having any visual appearance or effect over the positioning of the refrigerator cabinet relative to a kitchen wall would be advantageous.

SUMMARY OF THE INVENTION

The present invention relates to the use of a support tube mounted within the foam in place insulation located within a refrigerator cabinet. The support tube extends from a refrigerant tube access opening in the rear wall of the inner liner of the refrigerator, within a rear cavity located between the inner liner of the refrigerator cabinet and an exterior or outer shell for the refrigerator cabinet and through an exit opening in a bottom wall of the outer shell adjacent a compressor motor housing. The tube extends into and through this exit opening in the outer shell. The purpose of the tube is to allow a passageway through which a refrigerant tube in the form of suction tube may be slid through and secured in place during the manufacture of the refrigerator.

By having such a support tube with a refrigerant tube being inserted and extending therethrough, serviceability of the refrigerant tube in the field at a later time during the life of the refrigerator is readily available to a service operator. Further, the support tube is positively located within the rear cavity and is not subject to shifting during the foaming operation. Consequently, the refrigerant tube is positively located within the support tube and hence is not subject to shifting during the foaming operation which for most practical purposes eliminates sweating associated with shifting of the refrigerant tube. Also, with the support tube housing the refrigerant tube spaced within the insulation, there is no unsightly protruding suction tube beyond the back wall of the outer shell casing of the refrigerator cabinet.

In order to facilitate the insertion of the refrigerant tube within the support tube, which may either be a plastic or metallic tube, the refrigerant tube access in the rear wall of the liner has an elliptical shape with a vertical diameter that is larger than the horizontal diameter. The support tube will have a corresponding shape. Further, the support tube does not bend at a right angle as it extends from the rear wall of the inner liner and is instead gently curved from the rear wall of the inner liner. This gentle curvature and the elliptical shape allows for the refrigerant tubing to be inserted and slid downwardly along the support tube without the suction tube buckling. It should be understood that the diameter and wall thickness of the refrigerant suction tubing can result in easy bending of this tube. Accordingly, the elliptical shape of the liner access opening and the gentle curvature of the support tube facilitate the insertion of the refrigerant tube through the support tube.

The support tube has a first end that is extends through the bottom wall exit opening of the outer shell of the refrigerator. This first end of the support tube includes a flange like shoulder that locates and seals the support tube relative to the bottom wall of the exit opening.

The refrigerator cabinet may further include a support block of insulation material that is mounted to the rear wall of the inner liner within the rear cavity. The support block has a gently curved passageway that extends from the refrigerant tube access opening of the inner liner to a lower port facing into the rear cavity. The support tube is adapted to pass through this passageway in the insulation block and to be held by the support block adjacent the refrigerator tube access opening in the liner. Further, the support block is held against the inner liner by an oval shaped stick-on adhesive gasket that surrounds the refrigerant tube access opening and is fixed between the support block and the inner liner. The support block may also be held against the outer shell by at least one stick-on gasket.

During the manufacture of the refrigerator cabinet, the support block is mounted to the back wall of the outer shell at a predetermined location by the at least one first stick-on gasket. The support tube is inserted through the bottom wall exit opening in the cabinet outer shell and the support tube is then passed into the lower port of the support block and follows this passageway until the support tube extends substantially through, if not all the way through, the support block passageway. At this time, the shoulder flange of the other first end of the support tube is brought into engagement with the bottom wall and dimples in the outer shell of the cabinet. Next, the inner liner is mounted into the open front of the outer shell such that the refrigerant tube access opening in the rear wall of the inner liner is positioned substantially adjacent to the corresponding opening in the support tube. Also, a single sided, or double sided, sticking oval gasket is mounted to the block surrounding the oval tube such that when the liner is pressed against the block, the oval gasket seals the liner to the block.

In accordance with an aspect of the present invention there is provided a refrigerator cabinet comprising an outer shell having at least a back wall, a bottom wall and a first open front. The cabinet comprises a inner liner having at least opposing side walls, a rear wall and a second open front, the inner liner is positioned within the outer shell and defines a rear cavity between the rear wall of the inner liner and the back wall of the outer shell. A compressor motor housing is located below the bottom wall of the outer shell. The bottom wall of the outer shell has an exit opening between the rear cavity and the compressor motor housing. An evaporator housing is adapted to carry an evaporator coil and is positioned within the second open front of the inner liner adjacent the rear wall. A refrigerant tube access opening is in the rear wall of the inner liner adjacent the location where the evaporator housing meets the rear wall of the liner. A support tube extends from the refrigerant tube access opening in the rear wall of the inner liner within the rear cavity, through the exit opening of the outer shell and into the compressor motor housing. Foamed in place insulation is in the rear cavity and covers the support tube. A refrigerant tube extends from the evaporator housing to the compressor motor housing through the refrigerant tube access opening in the rear wall of the inner liner, through the support tube and through the exit opening in the bottom wall of the outer shell.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF THE PREFERRED EMBODIMENT

Figure 1:
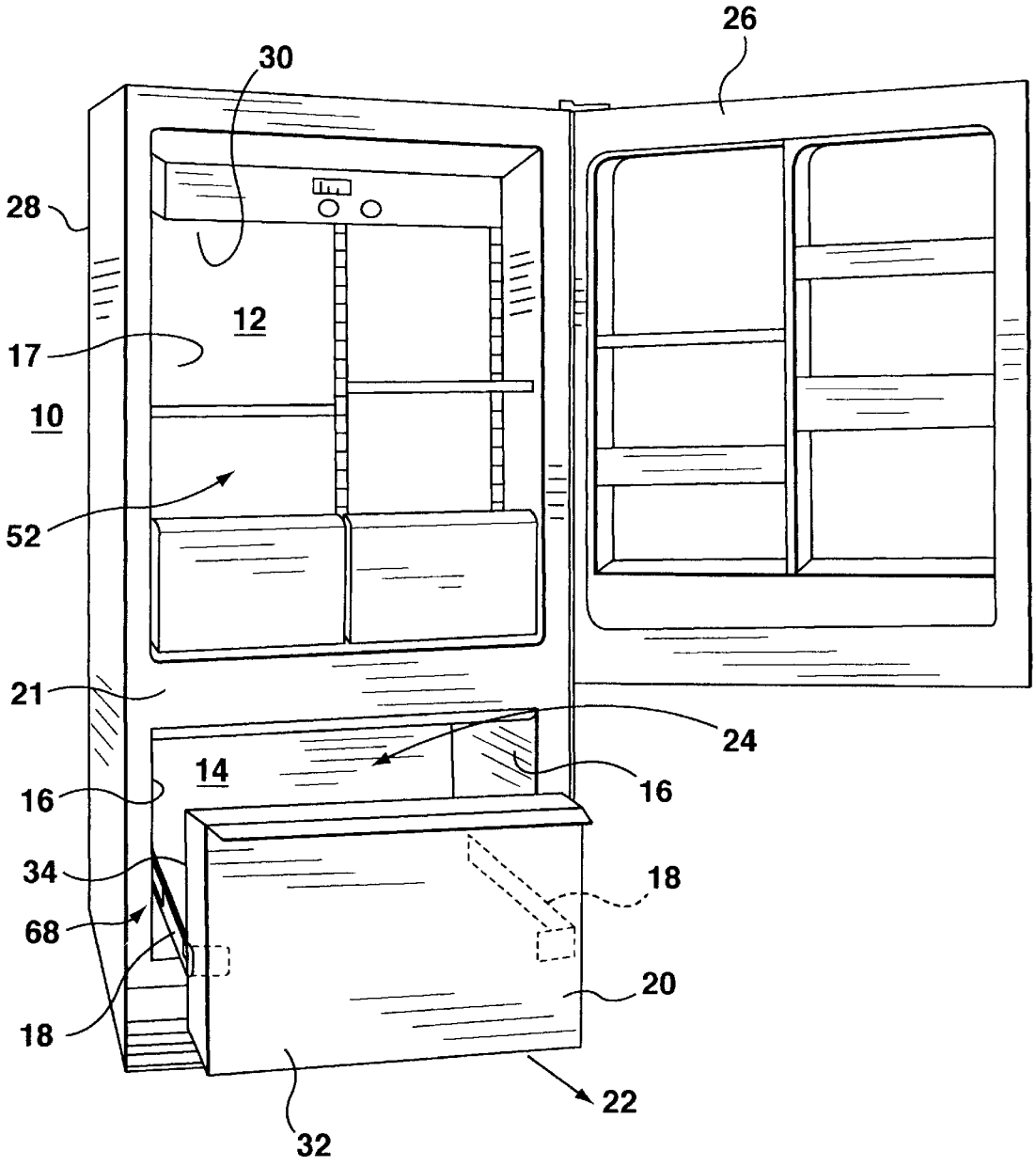
FIG. 1 is a front view of a bottom mount refrigerator having a pull-out door.
Figure 2:
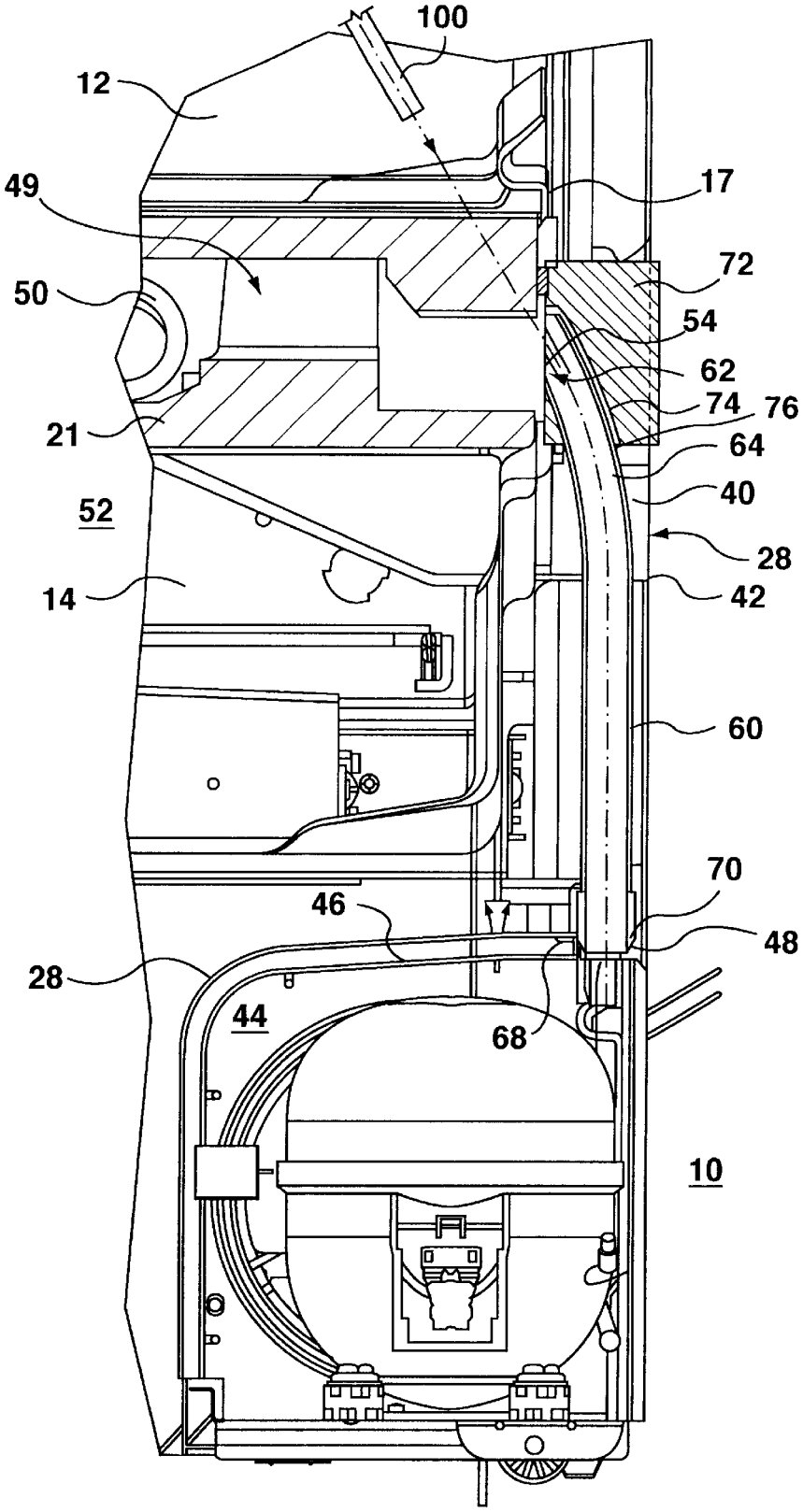
FIG. 2 is a partial side sectional view of the refrigerator of FIG. 1.
Figure 4:
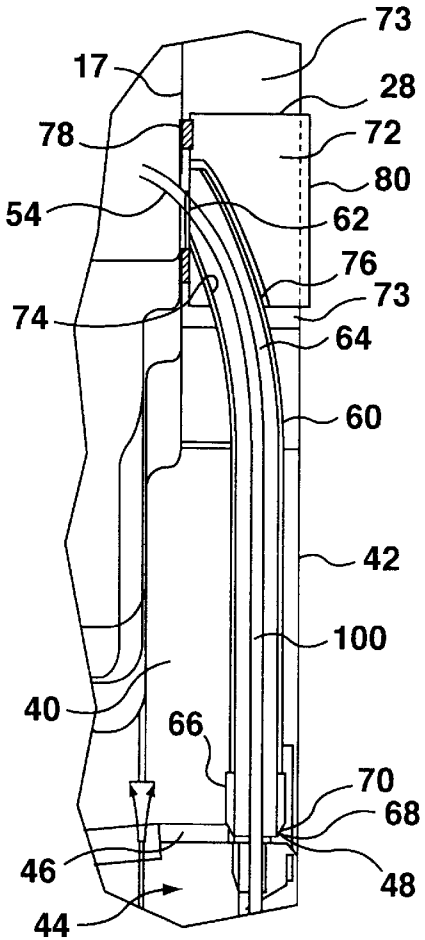
FIG. 4 is a partial side sectional view of the refrigerator of FIG. 3 taken at lines IV—IV of FIG. 3; and, FIG. 5 is a view similar to FIG. 2 where the evaporator coil and refrigerant tube are located in place.

In FIG. 1, a bottom mount refrigerator has a cabinet 10 that has an upper fresh food compartment 12, closed by door 26, and a lower freezer compartment 14. The lower food or freezer compartment 14 has opposing interior side walls 16 to which are mounted telescopic guide rails 18 for supporting pull-out door 20. Between the upper fresh food compartment 12 and the lower freezer compartment 14 is a dividing wall 21.

It should be understood that the insulated cabinet 10 typically comprises a metal outer shell 28 of a thin gauge of steel having an open front into which an inner liner 30 is positioned spaced from the metal shell by insulation (not shown). The insulation is typically a foamed in place polyurethane insulation which expands to fill the gap between the outer shell 28 and inner liner 30. The cabinet inner liner 30 may be either metal or plastic. The cabinet liner has side walls 16 and a rear wall 17.

The lower pull-out drawer door 20 also comprises an outer metal shell 32 and a door inner liner 34. The door liner 34 typically comprises a plastic material.

Referring to FIGS. 2 to 5, a rear cavity 40 is shown filled with insulation located between the rear wall 17 of the inner liner 30 and a back wall 42 of the outer shell 28.

A compressor motor housing 44 is located below a bottom wall 46 of the outer shell 28. The bottom wall 46 of the outer shell 28 has an exit opening 48 between the rear cavity 40 and the compressor motor housing 44.

An evaporator housing 49 is located in the dividing wall 21. The evaporator housing 49 carries evaporator coils 50 and is positioned in the open front 52 (FIG. 1) of the inner liner 30 extending between the liner side walls 16 and rear wall 17 to define the separate upper fresh food compartment 12 and lower freezer compartment 14. The lower freezer compartment 14 has a vertical length less than that of the upper fresh food compartment 12. It should be understood that while the evaporator housing 49 is shown to extend horizontally in the dividing wall 21, the evaporator and evaporator housing could easily extend vertically adjacent the rear liner wall.

Figure 3:
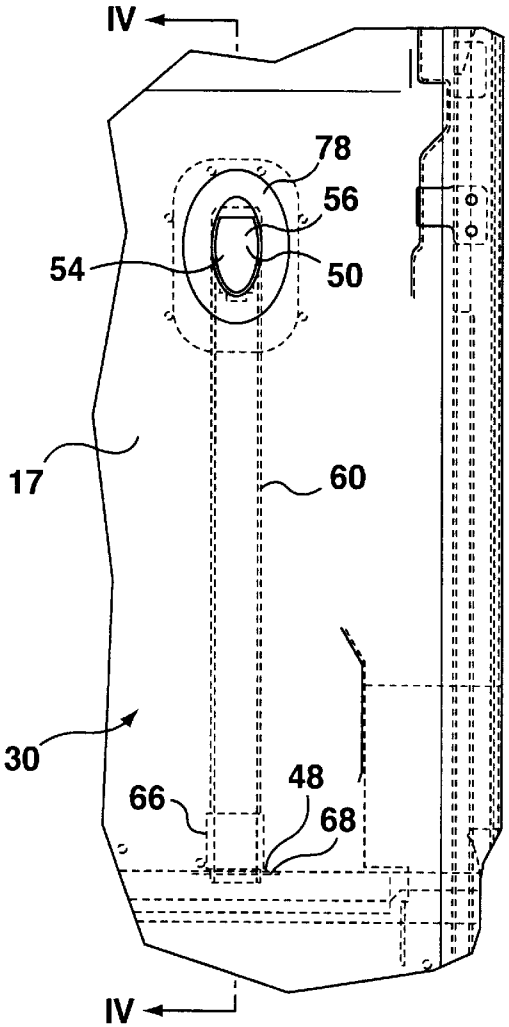
FIG. 3 is a front view of the inner liner with the evaporator housing removed.
Figure 5:
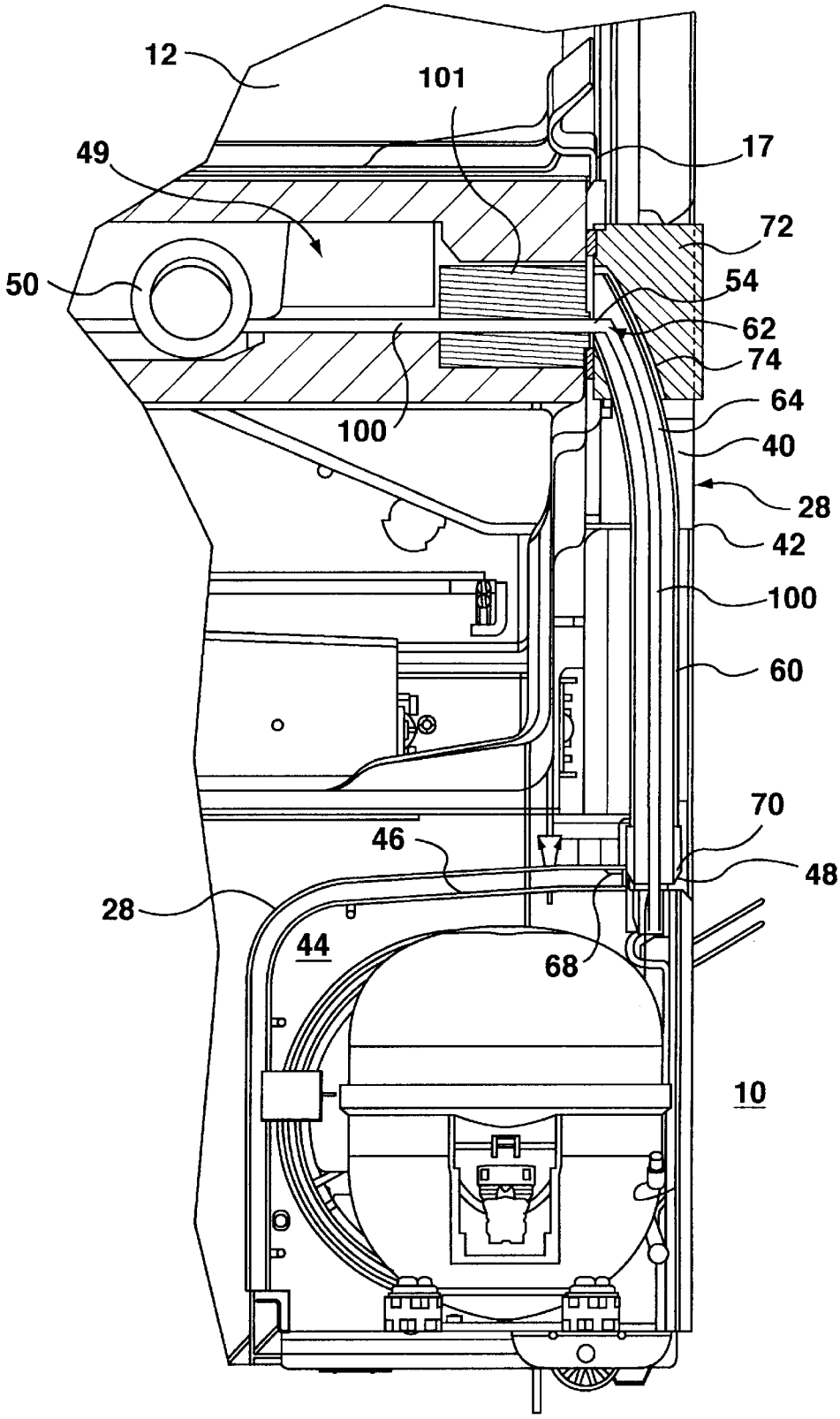

In FIG. 3, a refrigerant tube access opening 54 is shown cut into the rear wall 17 of the inner liner 17 adjacent the location where the evaporator housing 49 (FIG. 2) meets the rear wall 17 of the liner 30. The refrigerant tube access opening 54 of the rear wall 17 of the liner 30 has an elliptical shape with its vertical diameter 56 larger than its horizontal diameter 58.

A support tube 60, preferably of plastic, extends from the refrigerant tube access opening 54 within the rear cavity 40, through the exit opening 48 of the outer shell 28 and into the compressor motor housing 44. The support tube 60 has a corresponding access opening 62 adjacent the access opening 54 of the liner rear wall 17. The support tube 60 curves at 64 in a gentle angle of curvature from the liner rear wall 17 to extend substantially vertically through the rear cavity 40. The support tube has a first end 66 extending through the bottom wall exit opening 48 with a locating shoulder or annular flange 68 that locates and seals the support tube 60 relative to the bottom wall exit opening 48.

An insulated support block 72 is mounted to the back wall 42 and the rear wall 17 of the inner liner 30 within the rear cavity 40. The support block 72 has a gently curved passageway 74 extending from the refrigerant tube access opening 54 of the inner liner 30 to a lower port 76 facing into the rear cavity 40. The support tube 60 passes through the passageway 74 and is held by the support block 72 adjacent the refrigerant tube access opening 54 in the liner 30. The support block 72 is held against the inner liner 30 by an oval shaped stick on gasket 78 surrounding the refrigerant tube access opening 54 and fixed between the support block 72 and the inner liner 30. The support block 72 is held against the outer shell 28 by at least one stick on gasket 80. Location dimples 73 extending in from the rear wall of the outer shell also assist in locating the support block 72.

Foamed in place insulation (not shown) is blown into the rear cavity 40 and covers the support tube 60.

A refrigerant tube 100 extends from the evaporator coils 50 through an insulation block sleeve 101 (FIG. 5) in the evaporator housing 48 to the compressor motor housing 44 through the refrigerant tube access opening 54 in the rear wall 17 of the inner liner 30, through the support tube 60 and through the opening 43 in the bottom wall 48 of the outer shell 28. The tube 100 is generally at a right angle as it passes from insulation block sleeve 101 though aperture 50 and into tube 60. The sleeve 101 prevents air leakage through the tube 100 that may occur as a result of the sharp bend.

It will be appreciated that alternative embodiments falling within the scope of the present invention may be apparent to those skilled in the art and accordingly the present invention should not be limited to those embodiments herein described.

What is claimed is:

1. A refrigerator cabinet comprising:

an outer shell having at least a back wall, a bottom wall and a first open front;

an inner liner having at least opposing side walls, a rear wall and a second open front, the inner liner being positioned within the outer shell and defining a rear cavity between the rear wall of the inner liner and the back wall of the outer shell;

a compressor motor housing located below the bottom wall of the outer shell, and the bottom wall of the outer shell having an exit opening between the rear cavity and the compressor motor housing;

an evaporator housing adapted to carry an evaporator coil and positioned within the second open front of the inner liner adjacent the rear wall;

a refrigerant tube access opening in the rear wall of the inner liner adjacent the location where the evaporator housing meets the rear wall of the liner;

a support tube extending from the refrigerant tube access opening in the rear wall of the inner liner, within the rear cavity and through the exit opening of the outer shell and into the compressor motor housing;

foamed in place insulation in the rear cavity and covering the support tube; and, a refrigerant tube extending from the evaporator housing to the compressor motor housing through the refrigerant tube access opening in the rear wall of the inner liner, through the support tube and through the opening in the bottom wall of the outer shell.

2. The refrigerator cabinet of claim 1 wherein the refrigerant tube access opening of the rear wall of the liner has an elliptical shape with its vertical diameter larger than its horizontal diameter.

3. The refrigerator cabinet of claim 2 wherein the support tube has a corresponding access opening adjacent the access opening of the rear wall of the liner.

4. The refrigerator cabinet of claim 1 wherein the support tube curves at a gentle angle from the inner liner rear wall to extend substantially vertically through the rear cavity.

5. A refrigerator cabinet comprising:

an outer shell having at least a back wall, a bottom wall and a first open front;

an inner liner having at least opposing side walls, a rear wall and a second open front, the inner liner being positioned within the outer shell and defining a rear cavity between the rear wall of the inner liner and the back wall of the outer shell;

a compressor motor housing located below the bottom wall of the outer shell, and the bottom wall of the outer shell having an exit opening between the rear cavity and the compressor motor housing;

an evaporator housing adapted to carry an evaporator coil and positioned within the second open front of the inner liner adjacent the rear wall;

a refrigerant tube access opening in the rear wall of the inner liner adjacent the location where the evaporator housing meets the rear wall of the liner;

a support tube extending from the refrigerant tube access opening in the rear wall of the inner liner, within the rear cavity and through the exit opening of the outer shell and into the compressor motor housing, and the support tube having a first end adjacent the exit opening in the bottom wall, and the first end having a locating shoulder that locates and seals the support tube relative to the exit opening;

foamed in place insulation in the rear cavity and covering the support tube; and, a refrigerant tube extending from the evaporator housing to the compressor motor housing through the refrigerant tube access opening in the rear wall of the inner liner, through the support tube and through the opening in the bottom wall of the outer shell.

6. A refrigerator cabinet comprising:

an outer shell having at least a back wall, a bottom wall and a first open front;

an inner liner having at least opposing side walls, a rear wall and a second open front, the inner liner being positioned within the outer shell and defining a rear cavity between the rear wall of the inner liner and the back wall of the outer shell;

a compressor motor housing located below the bottom wall of the outer shell, and the bottom wall of the outer shell having an exit opening between the rear cavity and the compressor motor housing;

an evaporator housing adapted to carry an evaporator coil and positioned within the second open front of the inner liner adjacent the rear wall;

a refrigerant tube access opening in the rear wall of the inner liner adjacent the location where the evaporator housing meets the rear wall of the liner;

a support tube extending from the refrigerant tube access opening in the rear wall of the inner liner, within the rear cavity and through the exit opening of the outer shell and into the compressor motor housing;

foamed in place insulation in the rear cavity and covering the support tube;

a refrigerant tube extending from the evaporator housing to the compressor motor housing through the refrigerant tube access opening in the rear wall of the inner liner, through the support tube and through the opening in the bottom wall of the outer shell; and, a support block mounted to the back wall and the rear wall of the inner liner within the rear cavity, the support block having a gently curved passageway extending from the refrigerant tube access opening of the inner liner to a lower port facing into the rear cavity; the support tube passing through the passageway and being held by the support block adjacent the refrigerant tube access opening in the liner.

7. The refrigerator cabinet of claim 6 wherein the support block is held against the inner liner by an oval shaped stick on gasket surrounding the refrigerant tube access opening and fixed between the support block and the inner liner.

8. The refrigerator cabinet of claim 7 wherein the support block is held against the outer shell by at least one stick on gasket.

9. The refrigerator cabinet of claim 6 wherein the support block comprises an insulation material.

10. A bottom mount refrigerator cabinet comprising:

an outer shell having at least a back wall, a bottom wall and a first open front;

an inner liner having at least opposing side walls, a rear wall and a second open front, the inner liner being positioned within the outer shell and defining a rear cavity between the rear wall of the inner liner and the back wall of the outer shell;

a compressor motor housing located below the bottom wall of the outer shell, and the bottom wall of the outer shell having an exit opening between the rear cavity and the compressor motor housing;

an evaporator housing adapted to carry an evaporator coil and positioned in the second open front of the inner liner extending between the liner side walls and rear wall to define and separate an upper fresh food compartment and a lower freezer compartment where the lower freezer compartment has a vertical length less than that of the upper fresh food compartment;

a refrigerant tube access opening in the rear wall of the inner liner adjacent the location where the evaporator housing meets the rear wall of the liner;

a support tube extending from the refrigerant tube access opening in the rear wall of the inner liner, within the rear cavity and through the exit opening of the outer shell and into the compressor motor housing;

foamed in place insulation in the rear cavity and covering the support tube; and, a refrigerant tube extending from the evaporator housing to the compressor motor housing through the refrigerant tube access opening in the rear wall of the inner liner, through the support tube and through the opening in the bottom wall of the outer shell.

11. The refrigerator cabinet of claim 10 wherein the refrigerant tube access opening of the rear wall of the liner has an elliptical shape with its vertical diameter larger than its horizontal diameter.

12. The refrigerator cabinet of claim 11 wherein the support tube has a corresponding access opening adjacent the access opening of the rear wall of the liner.

13. The refrigerator cabinet of claim 10 wherein the support tube curves at a gentle angle from the inner liner rear wall to extend substantially vertically through the rear cavity.

14. The refrigerator cabinet of claim 13 wherein the support tube has a first end adjacent the bottom wall exit opening with a locating shoulder that locates and seals the support tube relative to the bottom wall exit opening.

15. The refrigerator cabinet of claim 10 further including a support block mounted to the back wall and the rear wall of the inner liner within the rear cavity, the support block having a gently curved passageway extending from the refrigerant tube access opening of the inner liner to a lower port facing into the rear cavity; the support tube passing through the passageway and being held by the support block adjacent the refrigerant tube access opening in the liner.

16. The refrigerator cabinet of claim 15 wherein the back wall of the outer shell has dimples for locating the support block.

17. The refrigerator cabinet of claim 16 wherein the support block is held against the inner liner by an oval shaped stick on gasket surrounding the refrigerant tube access opening and fixed between the support block and the inner liner.

18. The refrigerator cabinet of claim 17 wherein the support block is held against the outer shell by at least one stick on gasket.

19. The refrigerator cabinet of claim 16 wherein the support block comprises an insulation material.

* * * * *